US005669542A

United States Patent [19]

White

[11] Patent Number: 5,669,542

[45] Date of Patent: Sep. 23, 1997

[54] FASTENER DRIVING DEVICE HAVING FULL CYCLE VALVE

[75] Inventor: Brian M. White, Riverside, R.I.

[73] Assignee: Stanley-Bostitch, Inc., East Greenwich, R.I.

[21] Appl. No.: 650,142

[22] Filed: May 17, 1996

[51] Int. Cl.[6] ..... B25C 1/04

[52] U.S. Cl. ..... 227/8; 227/130; 91/308

[58] Field of Search ..... 227/8, 120, 130; 91/307, 308

[56] References Cited

U.S. PATENT DOCUMENTS

| | | | |
|---|---|---|---|
| 4,915,013 | 4/1990 | Moraht et al. . | |
| 5,174,485 | 12/1992 | Meyer . | |
| 5,485,946 | 1/1996 | Jankel | 227/130 |
| 5,511,714 | 4/1996 | Bauer et al. | 227/130 |
| 5,522,532 | 6/1996 | Chen | 227/130 |
| 5,597,106 | 1/1997 | Hamano et al. | 227/130 |

*Primary Examiner*—Scott A. Smith
*Attorney, Agent, or Firm*—Cushman Darby & Cushman, Intellectual Property Group of Pillsbury Madison & Sutro, L.L.P.

[57] ABSTRACT

A pneumatically operated fastener driving device includes a pilot pressure operated main valve movable from a normally closed position into an opened position closing an exhaust path and allowing a supply of air under pressure to be communicated with a piston chamber to initiate and effect the movement of a piston and fastener driving element through a fastener drive stroke. First passage structure is provided between a pilot pressure chamber and an exhaust port. A secondary valve member is mounted with respect to the first passage structure so as to be movable between an opened position permitting communication between the pilot pressure chamber and the exhaust port and a closed position preventing communication between the pilot pressure chamber and the exhaust port. Second passage structure communicates the piston chamber with the secondary valve member and with the exhaust path. Pressure over the drive piston in the piston chamber communicates with the secondary valve member to move the secondary valve member to its closed position preventing communication between the pilot pressure chamber and the exhaust port thereby causing the main valve to move to its closed position. The secondary valve member permits one full cycle of operation to be performed while the trigger member remains actuated thereby minimizing exposure of the fastener driving element and thus, damage thereto.

18 Claims, 6 Drawing Sheets

FASTENER DRIVING DEVICE HAVING FULL CYCLE VALVE

BACKGROUND OF THE INVENTION

This invention relates to a fastener driving device and, more particularly, to an air operated fastener driving device having a main valve and a secondary valve member permitting the device to complete one full operating cycle while a trigger thereof remains actuated.

Conventional trigger fire fastener driving devices or tools typically include a pilot pressure operated main valve movable in response to actuation of a trigger from a closed position to an opened position permitting air under pressure to communicate with a piston chamber for moving a piston and fastener driving element, thereby initiating a fastener drive stroke. Release of the trigger initiates the return stroke of the fastener driving element. With these types of devices, the operator may actuate the trigger longer than needed to drive a fastener which causes air over the piston to increase. This pressure may reach line pressure. Thus, the high pressure over the piston must be exhausted during the return stoke of the piston which tends to be noisy. Further, air consumption is high with trigger fire tools due to having to exhaust such high pressures. In addition, since high pressure may be unnecessarily applied to the piston which contacts a bumper of the tool at the end of the drive stroke, bumper life is reduced.

With trigger fire tools, if the operator actuates the trigger longer than needed, the driving element remains exposed or extending from the nose piece of the tool. When the operator moves from one position to another, the tip of the fastener driving element may be damaged or broken. Further, if the tool is an upholstery tool, the exposed tip of the fastener driving element may catch on the upholstery and thereby damage the fabric.

Fastener driving tools have been developed such that one full cycle of operation of the tool is completed while the trigger remains actuated. Thus, air over the piston remains relatively low, less than line pressure. This reduces noise and increases bumper life. Further, the fastener driving element is only exposed from the nose piece for a very short time, which eliminates the above-mentioned problems.

There is a always a need to provide a full cycle type fastener driving tool with an improved valve arrangement which is cost effective and easy to assemble.

SUMMARY OF THE INVENTION

An object of the present invention is to fulfill the need described above. In accordance with the principles of the present invention, this objective is accomplished by providing a pneumatically operated fastener driving device comprising a housing assembly including a cylinder therein, the housing assembly defining a fastener drive track. A drive piston is slidably sealingly mounted in the cylinder for movement through an operative cycle including a drive stroke and a return stroke. A fastener driving element is operatively connected to the piston and mounted in the fastener drive track for movement therein through a drive stroke in response to the drive stroke of the piston and a return stroke in response to the return stroke of the piston.

A fastener magazine assembly is carried by the housing assembly for feeding successive fasteners laterally into the drive track to be driven therefrom by the fastener driving element during the drive stroke thereof. A piston chamber is defined at one end of the cylinder and communicates with the drive piston. An air pressure reservoir communicates with the piston chamber. An exhaust path defined in the housing assembly communicates the piston chamber with the atmosphere when the exhaust path is in an opened condition. A pilot pressure operated main valve is movable from a normally closed position into an opened position closing the exhaust path and allowing a supply of air under pressure from the air pressure reservoir to be communicated with the piston chamber to initiate and effect the movement of the piston and fastener driving element through the fastener drive stroke thereof. The main valve has a first pressure responsive area defining with a portion of the housing assembly a pilot pressure chamber, and a second pressure responsive area in opposing relation to the first pressure responsive area and exposed to the supply of air under pressure. A feed orifice communicates the air pressure reservoir with the pilot pressure chamber.

An actuator is mounted for movement with respect to an exhaust port for controlling pressure in the pilot pressure chamber. The actuator is (1) normally disposed in an inoperative position closing the exhaust port such that pressure within the air pressure reservoir may communicate with the pilot pressure chamber as pilot pressure therein, and (2) movable in response to a manual actuating procedure into an operating position opening the exhaust port and exhausting the pilot pressure in the pilot pressure chamber through the exhaust port to atmosphere. A trigger member is mounted with respect to the housing assembly for manual movement from a normal, inoperative position to an operative position for moving the actuator to its operating position.

First passage structure is provided between the pilot pressure chamber and the exhaust port. A secondary valve member is also provided and the second passage structure communicates the piston chamber with the secondary valve member. The second passage structure communicates with the exhaust path when the exhaust path is in the opened condition. The secondary valve member is mounted with respect to the first passage structure so as to be movable between an opened position biased by the air under pressure communicated by the first passage structure permitting communication between the pilot pressure chamber and the exhaust port, and a closed position biased by air over the drive piston in the piston chamber via the second passage structure preventing communication between the pilot pressure chamber and the exhaust port.

An operative cycle of the device is initiated upon movement of the trigger member to its operative position which moves the actuator to its operating position exhausting pilot pressure in the pilot pressure chamber through the exhaust port causing the main valve to move to its opened position thereby initiating the fastener drive stroke. Pressure over the drive piston in the piston chamber and the second passage structure communicates with the secondary valve member to move the secondary valve member to its closed position preventing communication between the pilot pressure chamber and the exhaust port causing the main valve to move to its closed position, thereby completing one operative cycle while the trigger member remains in the operative position thereof.

The secondary valve member is constructed and arranged to return to the opened position thereof when the trigger member returns to the normal, inoperative position thereof.

Another object of the present invention is the provision of a fastener driving device of the type described which is simple in construction, effective in operation and economical to manufacture and maintain.

These and other objects of the present invention will become apparent during the course of the following detailed description and appended claims.

The invention may best be understood with reference to the accompanying drawings wherein an illustrative embodiment is shown.

DETAILED DESCRIPTION OF THE INVENTION

Figure 1:
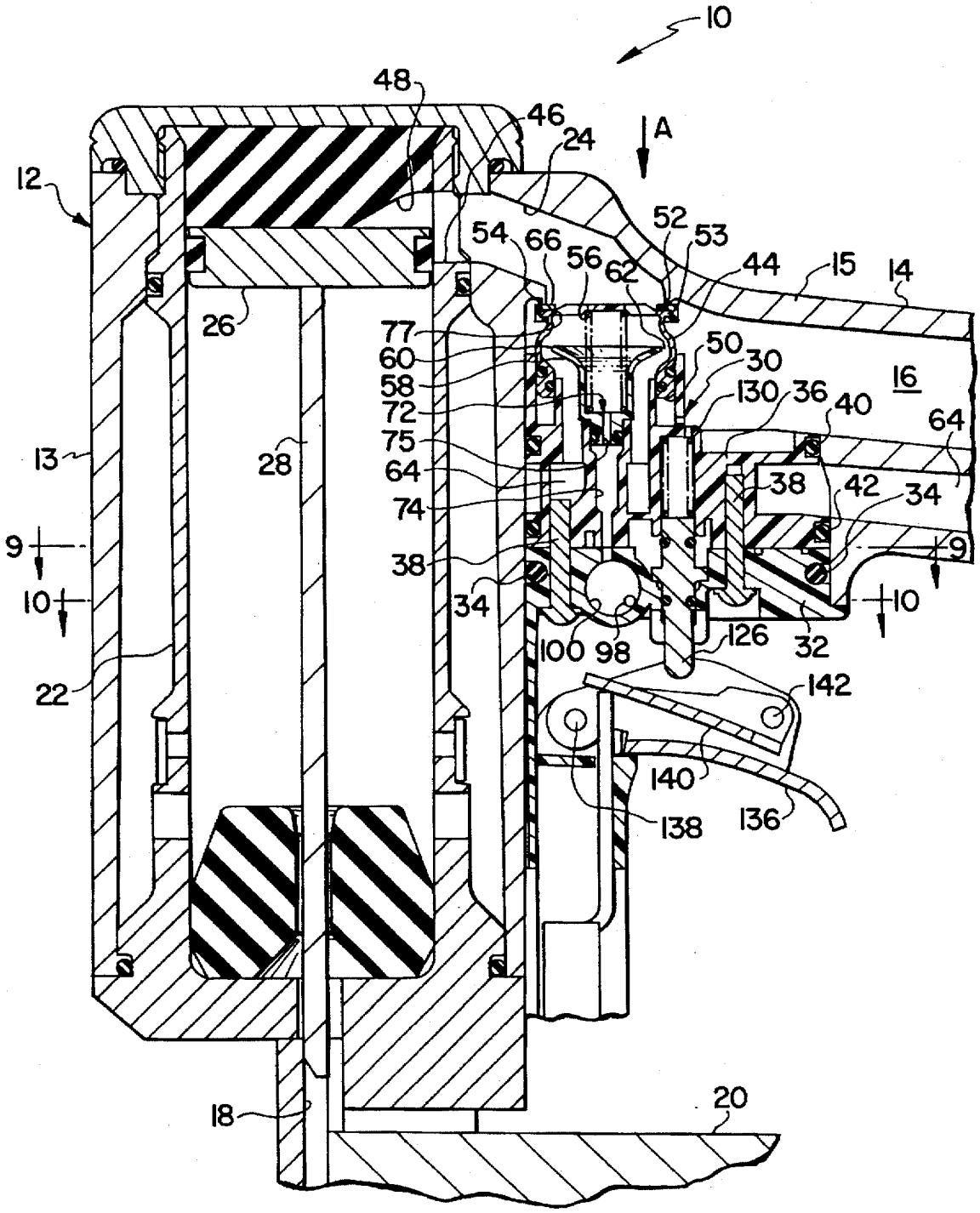
FIG. 1 is a partial sectional view of a fastener driving device including control valve structure provided in accordance with the principles of the present invention.

Referring now more particularly to the drawings, a pneumatically operated fastener driving device is shown, generally indicated at 10, in FIG. 1, which embodies the principles of the present invention. The device 10 includes the usual housing assembly, generally indicated at 12, having a cylindrical housing portion 13 and a frame housing portion 15, extending laterally from the cylindrical housing portion 13. A hand grip portion 14 of hollow configuration is defined in the frame housing portion 15, which constitutes a reservoir chamber 16 for air under pressure coming from a source which is communicated therewith. The housing assembly 12 further includes the usual nose piece defining a fastener drive track 18 which is adapted to receive laterally therein the leading fastener from a package of fasteners mounted within a magazine assembly 20 of conventional construction and operation.

Mounted within the cylindrical housing portion 13 is a cylinder 22 which has its upper end disposed in communicating relation with the reservoir chamber 16 via passageway 24. Mounted within the cylinder 22 is a piston 26. Carried by the piston 26 is a fastener driving element 28 which is slidably mounted within the drive track and movable by the piston and cylinder unit through a cycle of operation which includes a drive stroke during which the fastener driving element 28 engages a fastener within the drive track and moves the same longitudinally outwardly into a workpiece, and a return stroke.

Means is provided within the housing assembly 12 to effect the return stroke of the piston 26. For example, such means may be in the form of a conventional plenum chamber return system such as disclosed in U.S. Pat. No. 3,708,096, the disclosure of which is hereby incorporated by reference into the present specification.

In order to effect the aforesaid cycle of operation, there is provided control valve structure, generally indicated at 30, constructed in accordance with the present invention. The control valve structure 30 includes a housing unit, which, in the illustrated embodiment includes a trigger housing 32 removably coupled to the frame portion 15 by pin connections at 34, and a valve housing 36 secured to the trigger housing 32 by fasteners, preferably in the form of screws 38. Housings 32 and 36 are preferably molded from plastic material. O-rings 40 and 42 seal the valve housing 36 within the frame portion of the housing assembly 12.

Referring now more particularly to FIG. 1, in the illustrated embodiment, the control valve structure 30 includes a main valve 44 mounted with respect to the valve housing 36 and associated with the passageway 24 between one end 46 of the cylinder 22, and the reservoir chamber 16. The main valve 44 is moveable between opened and closed positions to open and close the passageway 24 and has a first annular pressure responsive surface 50 and a second, opposing annular pressure responsive surface 52. When the main valve 44 is closed, a portion 53 of surface 52 extends beyond annular housing seat 54 and is exposed to reservoir pressure in the reservoir chamber 16. Spring structure, in the form of a coil spring 56 biases the main valve 44 to its closed position, together with reservoir pressure acting on surface 50. Thus, the force of the spring 56 plus the force due to pressure acting on surface 50 is greater than the force due to pressure acting on the portion 53 of the opposing surface 52, which results in the keeping the main valve 44 in its closed position. The spring 56 is disposed between a surface of an exhaust seal 58 and a surface of the main valve 44. The exhaust seal 58 is fixed to the valve housing 36 and an upper annular surface 60 thereof contacts an inner surface of the main valve 44 when the main valve is in its fully opened position, thereby closing an exhaust path 62. Exhaust path 62 communicates with the atmosphere via the exhaust 64.

A urethane seal member 66 is attached to the upper end of the main valve 44 and ensures proper sealing when the main valve 44 is closed. Thus, when the main valve 44 is in its closed position, surface 52 and thus seal member 66 of the main valve is in sealing engagement with seat 54 of the housing assembly 12. O-ring seals 70 (FIG. 3) are provided for sealing the main valve 44 within the valve housing 36.

A passageway, generally indicated at 72, is defined through the main valve 44 and the exhaust seal 58. The passageway 72 includes passage 74 of the valve housing 36, passage 76 of the trigger housing 32, passage 75 of the exhaust seal 58 and passages 77 defined in the top surface of the main valve 44. The passageway 72 is part of second passage structure which provides a pressure signal to the secondary valve structure, as will become apparent below.

A pressure chamber 78 (FIG. 2) is defined between the first pressure responsive surface 50 of the main valve 44, and a portion of the valve housing 36. The pressure chamber 78 is in communication with the high pressure in reservoir chamber 16 via a feed orifice 80 to bias the main valve 44 to its closed position. This high pressure in chamber 78 is dumped to atmosphere to open the main valve 44, as will be explained below.

Figure 2:
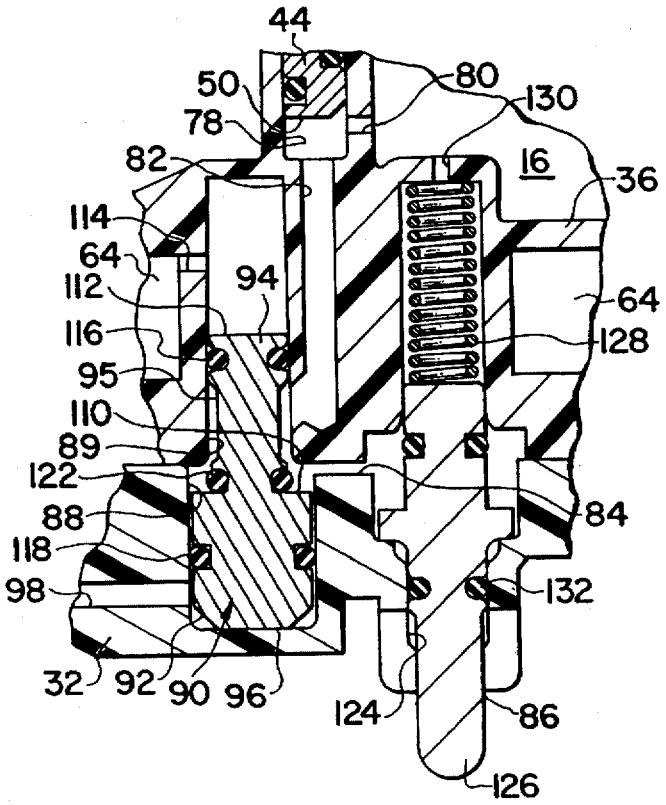
FIG. 2 is a partial sectional view of the control valve structure of FIG. 1 showing the relative positions of the main valve and secondary valve member when the device is at rest.

With reference to FIG. 2, first passage structure connects the pressure chamber 78 with an exhaust port 86. Passage 82, bores 88 and 89, bleed path 84 define the first passage structure between the pressure chamber 78 and the exhaust port 86, the function of which will be apparent below. It can be appreciated that the first passage structure may be of any configuration which permits communication between the pilot pressure chamber 78 and the exhaust port 86.

The control valve structure 30 includes a secondary valve member in the form of a shuttle valve 90 mounted with respect to the first passage structure in bore 88 of trigger housing 32 and bore 89 of valve housing 36 (FIG. 2). FIG. 2 shows the position of the shuttle valve 90 when the device 10 is at rest. The shuttle valve 90 is generally cylindrical and has a base portion 92 and a stem portion 94 extending from the base portion 92. The stem portion 94 has a reduced diameter portion 95, the function of which will become apparent below. The base portion 92 defines a first pressure receiving surface 96 which is in pressure communication with over-the-piston pressure, which is the pressure communicating with a piston chamber 48. This pressure may be exhaust pressure or high pressure, depending on what part of the cycle the device 10 is operating. Such communication is achieved since surface 96 communicates with port 98, which in turn communicates with bore 100, which is in communication with the passageway 72. The passageway 72 is open to passage 24 and thus open to the piston chamber 48. These passages define second passage structure providing communication between the shuttle valve 90 and the piston chamber 48. It can be appreciated that the second passage structure can be of any configuration which permits communication between the piston chamber and the secondary valve member.

Figure 9:
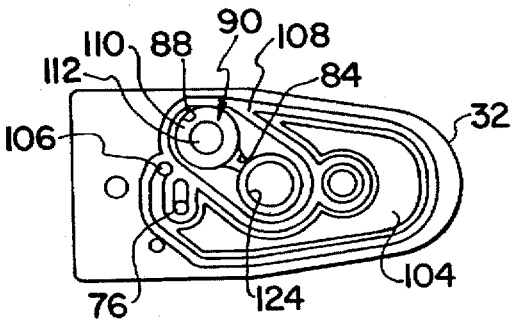
FIG. 9 is a view of the trigger housing of the control valve module taken along the line 9—9 of FIG. 1.
Figure 10:
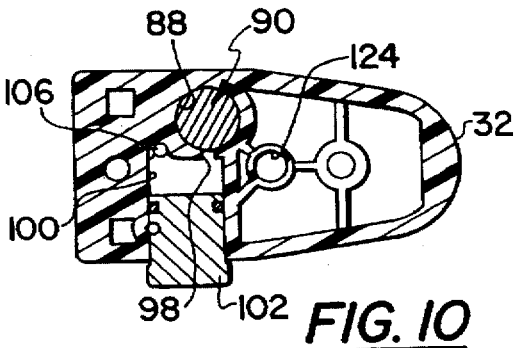
FIG. 10 is a sectional view taken along the line 10—10 of FIG. 1.

In the illustrated embodiment, a plug 102 (FIG. 10) is sealingly mounted in bore 100. When the valve housing 36 is coupled to the trigger housing 32, a pressure cavity 104 is defined. Port 106 is in communication with cavity 104 (FIG. 9) and communicates the pressure cavity 104 with the port 98 via bore 100. A seal member 108 provides a seal between the trigger housing 32 and the valve housing 36.

The shuttle valve 90 has a second pressure receiving surface 110 opposing the first pressure receiving surface 96 and in communication with the reservoir chamber 16 via passage 82 and the feed orifice 80. When the device 10 is at rest, reservoir pressure via port 130 also communicates with surface 110. Further, the stem portion 94 of the shuttle valve 90 includes a third pressure receiving surface 112 continuously exposed to the atmosphere via port 114. The surface area of annular surface 110 and annular surface 112 are each less than the surface area of annular surface 96. Port 114 communicates with the exhaust 64. As shown in FIG. 2, when the shuttle valve 90 is in its opened position normally biased by high pressure at surface 110, communicated through passage 82 via feed orifice 80 and via port 130, passage 82 communicates with the bleed path This occurs since the high pressure air may pass around the reduced diameter portion 95 of the shuttle valve 90. An o-ring 116 prevents this high pressure air from escaping to atmosphere through port 114 while o-ring 118 isolates the passage 82 from port 98. Surface 96 is exposed to atmospheric pressure since over-the-piston pressure in port 98 is atmospheric pressure due to the exhaust path 62 being open.

Figure 3:
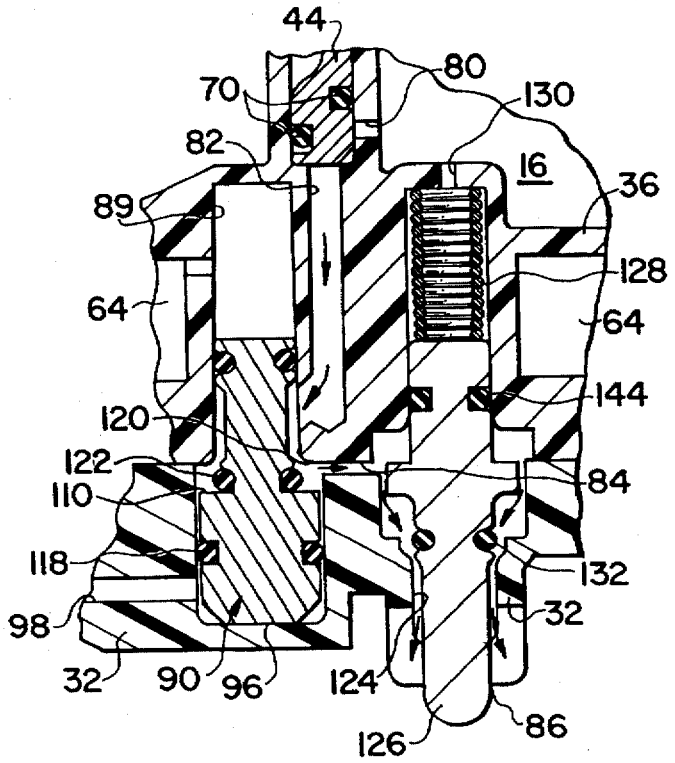
FIG. 3 is a sectional view similar to FIG. 2, showing an actuating member actuated moving the main valve to an opened position.
Figure 4:
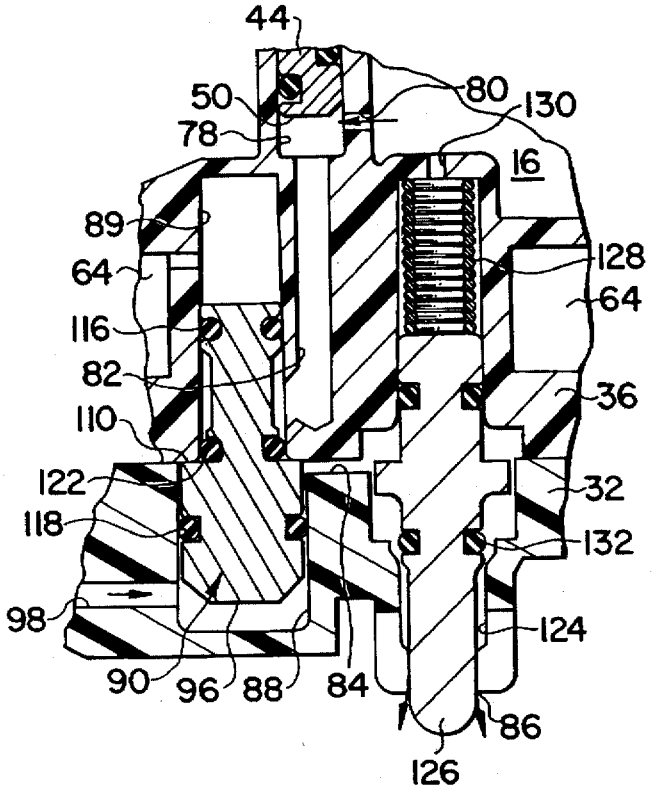
FIG. 4 is a view similar to FIG. 2, showing the main valve and secondary valve member in closed positions during a return stroke of the piston while the actuating member remains actuated.

With reference to FIG. 3, when the device 10 is actuated as explained more fully below, pressure in the pilot pressure chamber 78 is exhausted and port 130 is sealed, thereby permitting the main valve to open, initiating a fastener drive stroke. As a result, over-the-piston pressure or high pressure acts on surface 96 imposing a greater force than a force acting on surface 110 due to pressure communicating therewith; thus, the shuttle valve 90 is moved to its closed position (FIG. 4). In this position, surface 110 of the shuttle valve 90 engages surface 120 of the valve housing 36 so as to prevent communication between port 82 and the exhaust port 86. O-ring 116 seals off surface 112 and both o-rings 116 and 122 seal off port 82 creating a pneumatically balanced seal. O-ring 122 seals off port 86. Also, o-ring 118 prevents pressure in port 98 from communicating with the exhaust port 86. When the shuttle valve 90 is in this closed position, feed orifice 80 pressurizes pilot pressure chamber 78, closing the main valve, as will be explained in more detail below.

As shown in FIG. 2, the bleed path 84 connects the passage 82 and bores 88 and 89 with a trigger stem bore 124. The trigger stem bore 124 communicates with the exhaust port 86 and may be considered part of the exhaust port. A trigger stem 126, defining an actuator, is carried by the trigger housing 32 for movement from a normal, sealed position into an operative, unsealed position for initiating movement of the main valve 44 to its opened position, thereby initiating movement of the fastener driving element 28 through a fastener drive stroke. The actuator 126 is normally biased to its normal, sealed position by a spring 128, together with reservoir pressure exerted thereon via trigger port 130. Port 130 communicates with reservoir chamber 16. As shown in FIG. 2, in the sealed position, the actuator 126 engages a surface of the trigger housing 32 with an O-ring 132 compressed therebetween, sealing the exhaust port 86.

With reference to FIG. 1, in the illustrated embodiment, the control valve structure 30 includes a trigger assembly including a trigger member 136 pivoted to the trigger housing 32 at pin 138 for manual movement from a normal, inoperative position into an operative position. The trigger assembly also includes a rocker arm 140 which is pivoted to the trigger member 136 via a pin 142. Upward movement of the trigger member 136 causes the rocker arm 140 to engage and move the actuator 126 from its sealed position to its operative, unsealed position.

The operation of the control valve structure and thus the device 10 will be appreciated with reference to FIGS. 1–10. As shown in FIG. 2, when the device 10 is at rest, reservoir pressure from feed orifice 80 acting on surface 50 biases the main valve 44 against seat 54 of the housing assembly 12 preventing reservoir pressure from entering the upper end 46 of the cylinder 22. The main valve 44 is biased upwardly since the area of pressure responsive surface 50 is greater than the surface area of portion 53 (FIG. 1) extending beyond seat 54. High pressure in chamber 78 enters the passage 82 and bores 88 and 89 and biases the shuttle valve 90 to its opened position together with reservoir pressure from port 130. Thus, high pressure exerted on surface 110 of the shuttle valve 90 opens the shuttle valve. Pressure in port 98 is exhausting pressure since the piston chamber 48 is exposed to atmospheric pressure via the passageway 72 and the exhaust path 62. The actuating member 126 is biased to its normal, sealed position with exhaust port 86 closed.

As shown in FIG. 3, when the actuator 126 is moved upwardly by manual movement of the trigger member 136, exhaust port 86 is opened which dumps the pressure in the pilot pressure chamber 78 to atmosphere via the passage 82, bores 88 and 89 and bleed path 86. This causes the main valve 44 to shift to its opened position as shown in FIG. 3, permitting the high pressure to pass through passageway 24 and into the piston chamber 48 to cause the fastener driving element 28 to move through a drive stroke. The actuator 126 includes an upper o-ring 144 which seals off reservoir pressure directed from port 130 before the o-ring 132 is unsealed with respect to the trigger stem bore 124. At this time, over-the-piston pressure is high pressure which passes through the passageway 72 and into port 98.

As shown in FIG. 3, when the main valve 44 is opened fully, the force created by high pressure acting on pressure surface 52 (FIG. 1) is greater than the force of the spring 56 at its compressed height plus the force created by atmospheric pressure acting on surface 50. In this position and with reference to FIG. 1, it can be appreciated that the main valve 44 engages the annular surface 60 of the exhaust seal 58 which closes passageway 62 preventing pressure in the piston chamber 48 from exiting the device 10 through the exhaust 64.

Over-the-piston pressure air or high pressure air bleeds through the passageway 72 into bore 100 and through port 98 under the shuttle valve 90 and into port 106 and thus into cavity 104. Cavity 104 provides a volume for air to build which controls piston dwell at the bottom of its stroke. Cavity 104 provides adequate dwell to decay pressure in pilot pressure clamber 78. Over-the-piston pressure air builds in cavity 104 and communicates with surface 96 of the shuttle valve 90 via port 98, thus, shifting the shuttle valve 90 to its closed position, as shown in FIG. 4. This occurs since force created by over-the-piston pressure acting on surface 96 is greater than pressure acting on surface 110 and the atmospheric pressure acting on surface 112. Thus, as shown in FIG. 4, with the actuator 126 still actuated, during the return stroke of the fastener driving element, the over-the-piston pressure or high pressure in passage 98 shifts the shuttle valve 90 to its closed position preventing communication between passage 82 and the exhaust port 86. Chamber 78 is filled with reservoir pressure via feed orifice 80. The feed orifice is sized to control the piston dwell at the bottom of its stroke. High pressure air then shifts the main valve 44 to its closed position such that seal member 66 is engaged with seat 54 of the housing assembly 12 (FIG. 1). Over-the-piston pressure exhausts through path 62 and through the exhaust 64. Over-the-piston pressure in cavity 104 bleeds through port 106 (FIG. 9) and then through passage 76 and through passageway 72, through path 62 and finally bleeds out through the exhaust 64. As noted above, the configuration of the shuttle valve 90 and o-rings 116 and 122 provides a pneumatically balanced seal. Thus, once the shuttle valve 90 is closed, it remains closed via 116, 122 & 118 O-ring friction until the trigger member is released, as explained below.

Figure 5:
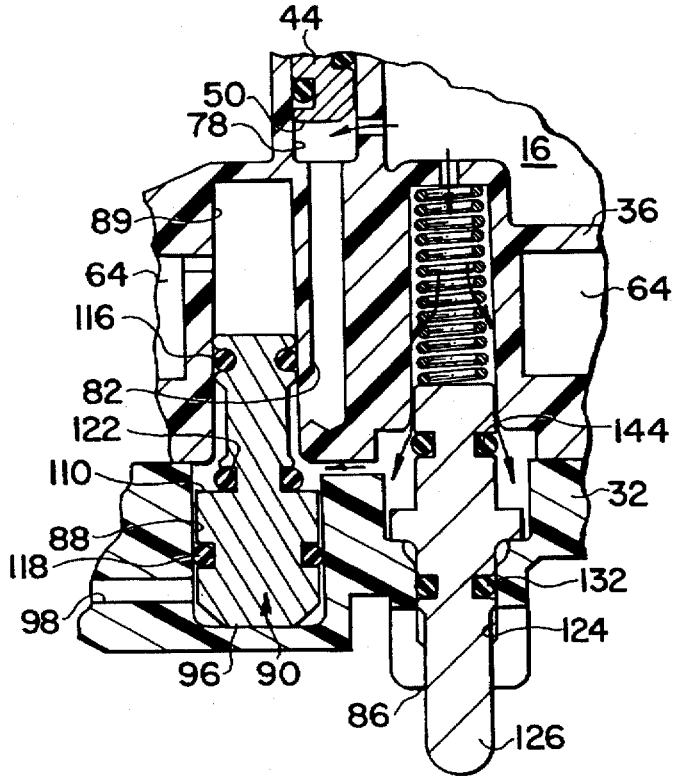
FIG. 5 is a view similar to FIG. 2, showing the actuating member released, with the main valve disposed in the closed position thereof and the secondary valve member returned to the opened position thereof.
Figure 6:
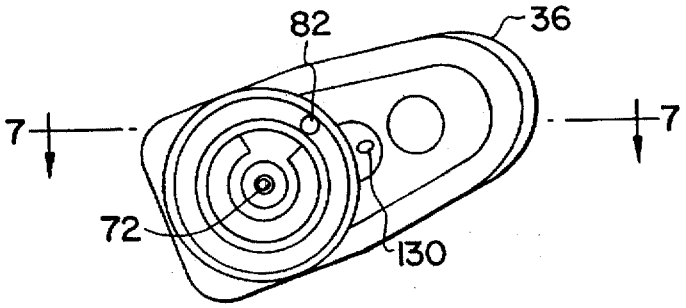
FIG. 6 is a view of a portion of the control valve module as seen in the direction of arrow A of FIG. 1, shown with the main valve removed for clarity of illustration.
Figure 7:
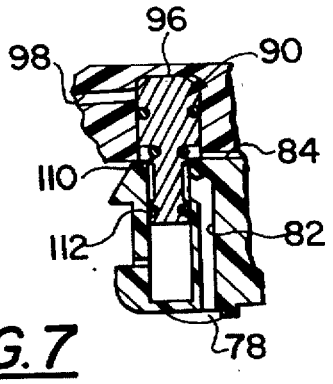
FIG. 7 is a partial sectional view taken along the line 7—7 of FIG. 6, showing the secondary valve member in an opened position.
Figure 8:
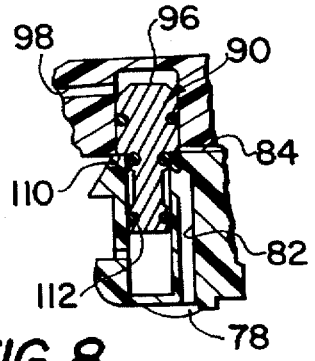
FIG. 8 is a partial sectional view taken along the line 7—7 in FIG. 6, showing the secondary valve member in a closed position.

With reference to FIG. 5, release of the trigger member 136 permits the actuator 126 to move to its sealed position. This causes high pressure air to bleed past o-ring 144 and be exerted on surface 110 of the shuttle valve 90, thereby biasing or resetting the shuttle valve 90 to its opened position, with the main valve 44 in the closed position thereof, as shown in FIG. 5. Over-the-piston pressure in passage 98 and under the shuttle valve 90 is exhaust pressure since the main valve 44 is closed and the exhaust path 62 is opened. Thus, it can be appreciated that one full cycle is completed while the trigger member 136 is actuated. Release of the trigger member 136 resets the shuttle valve 90 and the device 10 is ready to be actuated again.

It can be appreciated that by positioning the main valve 44 in the frame of the device 10, the overall tool height is reduced. Further, since in the illustrated embodiment, the control valve structure 30 is in the form of a single unit, removable from the housing 12, the device 10 is easy to assembly and service.

Figure 11:
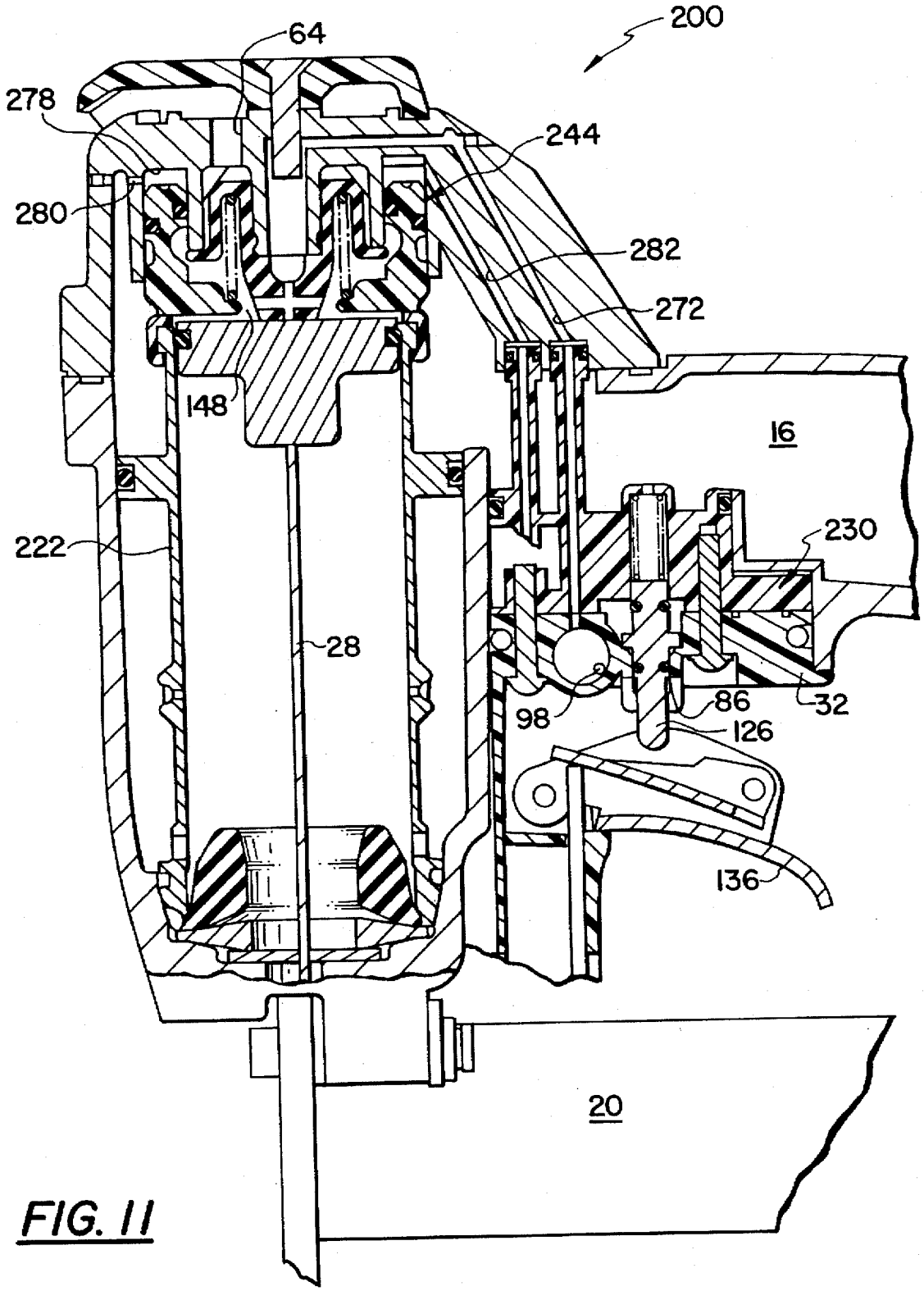
FIG. 11 is a partial sectional view of another embodiment of a fastener driving device including a secondary valve member and a remote main valve.

It can also be appreciated that the main valve and shuttle valve may be arranged in various positions with respect to the housing and may have various configurations, yet perform the same function as disclosed above. In particular, with reference to FIG. 11, it can be appreciated that the main valve 244 may be disposed above the cylinder 222. As shown, the main valve 244 is generally identical to that of the embodiment of FIG. 1, but is in an inverted position above the cylinder 222. The shuttle valve (not shown) is mounted in housing assembly 230, similarly to that of the embodiment of FIG. 1. Feed orifice 280 connects the pilot pressure chamber 278 with the reservoir 16. Passage 282 communicates with the exhaust port 86 when the shuttle valve is in its opened position, as in the embodiment of FIG. 1. An over-the-piston feed passageway 272 is provided which communicates the over-the-piston pressure in chamber 148 with the shuttle valve in the manner discussed above. Thus, when the trigger member 136 is pulled moving the actuator 126 upwardly, the device will complete one full cycle as described above, so long as the trigger member 136 remains pulled.

Figure 12:
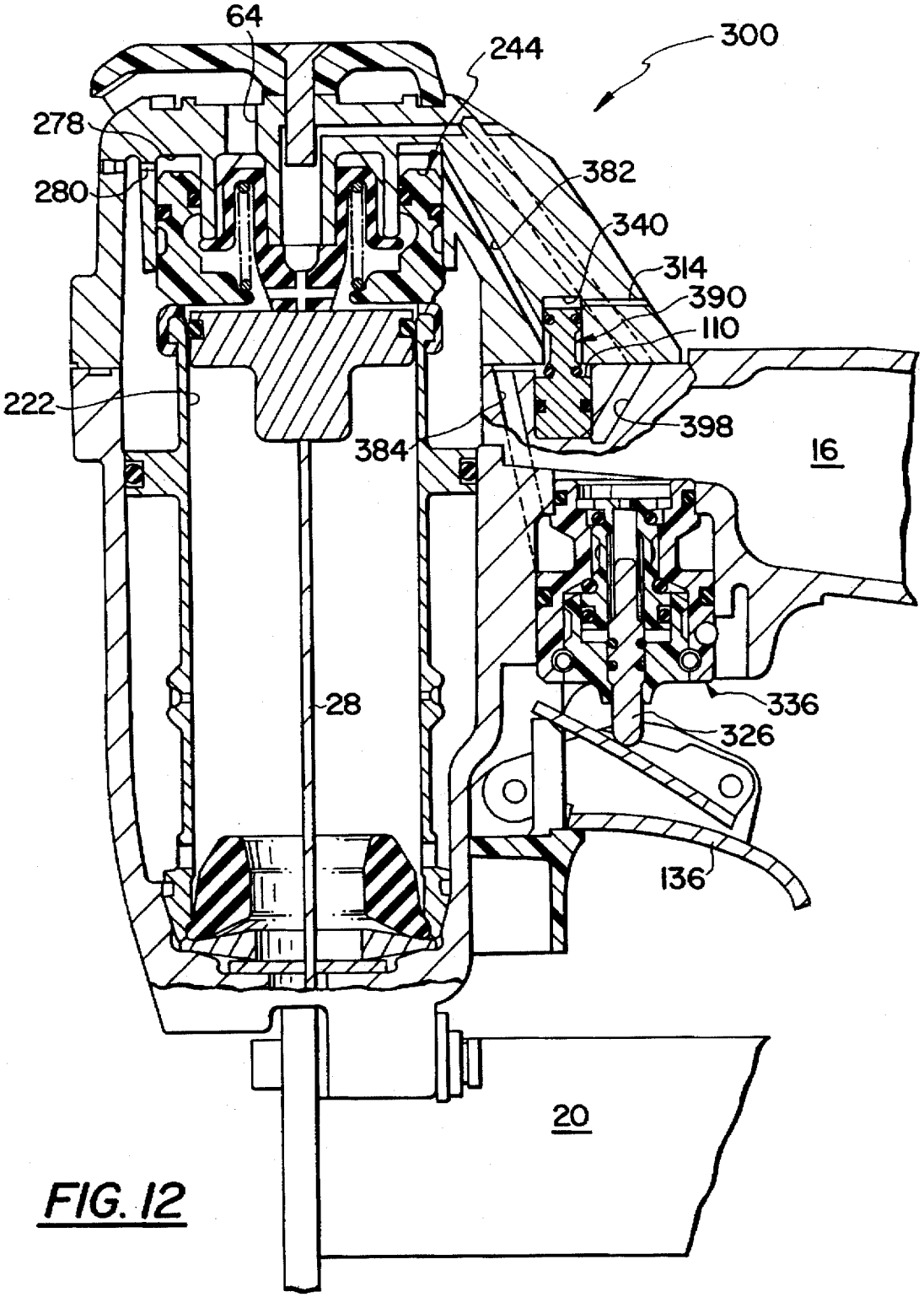
FIG. 12 is a partial sectional view of yet another embodiment of a fastener driving device including a remote secondary valve member and a remote main valve.

FIG. 12 shows yet another embodiment of the present invention wherein like parts are designated with like numerals. As shown, the device 300 includes a shuttle valve 390 is disposed in the tool housing and has a conventional trigger valve assembly 336. The main valve 244 is disposed above the cylinder 222 an is identical to valve 244 of FIG. 11. The trigger valve assembly 336 may be of the type disclosed in, for example, U.S. Pat. No. 5,083,694, the disclosure of which is hereby incorporated by reference into the present specification. Chamber 340 above the shuttle valve 390 is exposed to atmosphere via port 314. Over-the-piston pressure is communicated with the shuttle valve via port 398. Passage 382 is similar to passage 82 discussed above. When the trigger member 136 is pulled to move the actuator 326, pressure in the pilot pressure chamber 278 is dumped to atmosphere initiating the operating cycle of the device. Pressure from port 384 will reset the shuttle valve 390 when the actuator 326 is released, by directing high pressure to surface 110 of the shuttle valve 390.

It can thus be seen that the main valve and shuttle valve arrangement ensures that one full cycle of operation is completed while the trigger member remains actuated. Release of the trigger member resets the device 10 for another full cycle. Since the fastener driving element is only exposed for a very brief time to drive the fastener, damage to the fastener driving element may be prevented, even if the operator holds the trigger for a time longer than necessary to drive the fastener. Further, after the drive stroke, pressure over the piston will not reach line pressure with the trigger member actuated. Thus, exhausting the pressure over the piston during the return stroke results in quieter tool operation.

While the invention has been described in connection with what is presently considered to be the most practical and preferred embodiment, it is understood that the invention is not limited to the disclosed embodiment, but, on the contrary, is intended to cover various modifications and equivalent arrangements included within the spirit and scope of the appended claims.

What is claimed is:

1. A pneumatically operated fastener driving device comprising:

a housing assembly including a cylinder therein, said housing assembly defining a fastener drive track, a drive piston slidably sealingly mounted in said cylinder for movement through an operative cycle including a drive stroke and a return stroke, a fastener driving element operatively connected to said piston and mounted in said fastener drive track for movement therein through a drive stroke in response to the drive stroke of the piston and a return stroke in response to the return stroke of the piston, a fastener magazine assembly carried by said housing assembly for feeding successive fasteners laterally into the drive track to be driven therefrom by said fastener driving element during the drive stroke thereof, a piston chamber defined at one end of said cylinder and communicating with said drive piston, an air pressure reservoir communicating with said piston chamber, an exhaust path defined in said housing assembly communicating the piston chamber with the atmosphere when the exhaust path is in an opened condition, a pilot pressure operated main valve movable from a normally closed position into an opened position closing the exhaust path and allowing a supply of air under pressure from the air pressure reservoir to be communicated with the piston chamber to initiate and effect the movement of the piston and fastener driving element through the fastener drive stroke thereof, said main valve having a first pressure responsive surface defining with a portion of said housing assembly a pilot pressure chamber, and a second pressure responsive surface in opposing relation to said first pressure responsive surface, said second pressure responsive surface being exposed to the supply of air under pressure, a feed orifice communicating the air pressure reservoir with the pilot pressure chamber, an actuator mounted for movement with respect to an exhaust port for controlling pressure in the pilot pressure chamber, said actuator being (1) normally disposed in an inoperative position closing the exhaust port such that pressure within said air pressure reservoir may communicate with said pilot pressure chamber as pilot pressure therein, and (2) movable in response to a manual actuating procedure into an operating position opening the exhaust port and exhausting the pilot pressure in said pilot pressure chamber through the exhaust port to atmosphere, a trigger member mounted with respect to said housing assembly for manual movement from a normal inoperative position to an operative position for moving the actuator to its operating position, first passage structure between the pilot pressure chamber and the exhaust port, a pressure responsive secondary valve member movable between a normally opened position and a closed position, second passage structure communicating said piston chamber with said secondary valve member, said second passage structure communicating with said exhaust path when said exhaust path is in the opened condition, said secondary valve member being mounted with respect to said first passage structure so as to be movable between an opened position biased by said air under pressure via said first passage structure permitting communication between said pilot pressure chamber and said exhaust port, and a closed position biased by air over the drive piston communicated from said piston chamber via said second passage structure preventing communication between said pilot pressure chamber and said exhaust port, an operative cycle being initiated upon movement of said trigger member to its operative position which moves said actuator to its operating position exhausting pilot pressure in said pilot pressure chamber through said exhaust port and causing said main valve to move to its opened position thereby initiating the fastener drive stroke, pressure over said drive piston in said piston chamber and said second passage structure communicating with said secondary valve member to move said secondary valve member from the opened position thereof to the closed position thereof causing said main valve to move to its closed position thereby completing one said operative cycle while said trigger member remains in the operative position thereof, said secondary valve member being constructed and arranged to return to the opened position thereof when said trigger member is permitted to move to the normal inoperative position thereof.

2. The pneumatically operated fastener driving device according to claim 1, wherein said housing assembly includes a cylindrical portion housing said cylinder and a frame portion extending generally laterally from said cylindrical portion, said frame portion having an annular seat, said main valve including an annular surface which engages said seat in sealing relation when said main valve is in its closed position, said second pressure responsive surface of said main valve including a portion extending beyond said annular seating surface and exposed to said air under pressure in said pressure reservoir when said main valve is in its closed position.

3. The pneumatically operated fastener driving device according to claim 2, wherein at least a portion of said annular surface of said main valve includes a urethane seal member thereon.

4. The pneumatically operated fastener driving device according to claim 3, wherein said main valve, said secondary valve and said actuator are mounted with respect to a housing unit, said housing unit including:

a valve housing, said main valve being mounted with respect to said valve housing, and a trigger housing coupled to said valve housing, said trigger member being coupled to said trigger housing.

5. The pneumatically operated fastener driving device according to claim 4, wherein said valve housing is coupled to said trigger housing by fasteners and said trigger housing is removably coupled to said frame portion of said housing assembly.

6. The pneumatically operated fastener driving device according to claim 4, wherein said housing unit is constructed and arranged with respect to said frame portion of said housing assembly so as to be removable therefrom as a unit.

7. The pneumatically operated fastener driving device according to claim 1, wherein said feed orifice is sized to control dwell of said piston at a bottom of its stroke.

8. The pneumatically operated fastener driving device according to claim 1, wherein said secondary valve member is generally cylindrical and has a base portion mounted in a first housing bore and a stem portion extending from said base portion and mounted in a second housing bore, said base portion having opposing first and second pressure receiving surfaces, and a surface of said stem portion being continuously exposed to atmospheric pressure via a vent port.

9. The pneumatically operated fastener driving device according to claim 8, wherein a surface area of said first pressure receiving surface is greater than a surface area of said second pressure receiving surface such that when said first pressure receiving surface is exposed to air under pressure communicated from said piston chamber, said secondary valve member moves to the closed position thereof.

10. The pneumatically operated fastener driving device according to claim 9, wherein actuator is mounted for movement within an actuator bore defined in said housing, said actuator bore defining said exhaust port, said first passage structure including a bleed path in open communication with said second pressure receiving area of said secondary valve member and in communication with said exhaust port, the device further comprising a spring biasing said actuator to its normal, sealed position together with said air under pressure in communication with said actuator communicated from a trigger port connected to the air pressure reservoir, said actuator including a first seal member disposed in sealing relation with said exhaust port when said actuator is in its normal, sealed position and a second seal member disposed in a sealing position preventing air under pressure from the trigger port to communicate with the exhaust port and the bleed path when said actuator is in its operating position, return of said actuator to the sealed position thereof with the first seal member in sealing relation and second seal member in an unsealed position permits air under pressure from the trigger port to enter the bleed path and be exerted on said second pressure receiving surface of the secondary valve member thereby moving the secondary valve member to the opened position thereof.

11. The pneumatically operated fastener driving device according to claim 10, wherein said first and second seal members are constructed and arranged such that as said actuator is moved to the operative position thereof, said second seal member is disposed in the sealing position thereof before said first seal member is in unsealed relation with the exhaust port.

12. The pneumatically operated fastener driving device according to claim 9, wherein said second pressure receiving surface of said secondary valve member, in the closed position thereof, contacts a housing seating surface preventing communication between said pilot pressure chamber and said exhaust port.

13. The pneumatically operated fastener driving device according to claim 12, wherein said secondary valve member includes a first seal adjacent said second pressure receiving surface of the secondary valve member which sealingly engages with the second housing bore when said secondary valve member is in the closed position thereof.

14. The pneumatically operated fastener driving device according to claim 13, wherein a second seal is sealingly engaged with said first housing bore and associated with said base portion to prevent communication between said first passage structure and said second passage structure, and said stem portion includes a third seal engaged with said second housing bore preventing said first passage structure from communicating with the vent port.

15. The pneumatically operated fastener driving device according to claim 1, wherein said housing includes a cylindrical portion housing said cylinder and a frame portion extending generally laterally from said cylindrical portion, said main valve and said secondary valve being disposed in a housing unit, said housing unit being constructed and arranged to be removed from said housing assembly.

16. The pneumatically operated fastener driving device according to claim 15, wherein said housing unit includes a valve housing and a trigger housing coupled to said valve housing, said trigger member being coupled to said trigger housing and said main valve being mounted with respect to said valve housing.

17. The pneumatically operated fastener driving device according to claim 1, further including a spring biasing said actuator to its normal, sealed position together with said air under pressure communicated to said actuator from a port which communicates with the air pressure reservoir, said actuator including a seal member which seals said exhaust port when said actuator is in its sealed position.

18. The pneumatically operated fastener driving device according to claim 1, further including a spring biasing said main valve towards its closed position.

* * * * *